United States Patent [19]

Narita

[11] Patent Number: 5,028,843

[45] Date of Patent: Jul. 2, 1991

[54] COMPACT DISCHARGE LAMP FOR USE IN OPTICAL PROJECTION SYSTEMS

[75] Inventor: Mitsuo Narita, Takasago, Japan

[73] Assignee: Ushio Denki Kabushiki Kaisha, Japan

[21] Appl. No.: 490,312

[22] Filed: Mar. 8, 1990

[30] Foreign Application Priority Data

Mar. 29, 1989 [JP] Japan ..... 1-74862

[51] Int. Cl.[5] ..... H01J 61/18

[52] U.S. Cl. ..... 313/641; 313/642; 313/638; 313/639; 313/640

[58] Field of Search ..... 313/639, 640, 641, 642, 313/638, 637

[56] References Cited

U.S. PATENT DOCUMENTS

| | | | |
|---|---|---|---|
| 3,514,659 | 5/1970 | Gungle et al. | 313/641 |
| 3,761,758 | 9/1973 | Bamberg et al. | 313/640 |
| 4,686,419 | 8/1987 | Block et al. | 313/641 |
| 4,801,846 | 1/1989 | Kramer et al. | 313/641 |

*Primary Examiner*—Donald J. Yusko
*Assistant Examiner*—Ashok Patel
*Attorney, Agent, or Firm*—Finnegan, Henderson, Farabow, Garrett & Dunner

[57] ABSTRACT

Disclosed herein is a lighting lamp having a light-emitting tube in which lutetium (Lu), lithium (Li) and a halogen are sealed together with mercury and a rare gas. The lighting lamp satisfies the following conditions (1) and (2):

(1) the proportion Li/Lu (the ratio in terms of the number of atoms of lithium to lutetium) is 0.5 to 1.5; and (2) the sealed amount of the halogen is the total of a stoichiometric amount of halogen in which the halogen form halides with lutetium and lithium to be sealed and an excess amount of $0.5\times10^{-6}$ to $4\times10^{-6}$ molecular mole/cc based on the internal volume of the light-emitting tube.

3 Claims, 2 Drawing Sheets

COMPACT DISCHARGE LAMP FOR USE IN OPTICAL PROJECTION SYSTEMS

BACKGROUND OF THE INVENTION

1. Field of the Invention

This invention relates to a lighting lamp excellent in color rendering properties in a red region, and specifically to a lighting lamp suitable for use in a light source for the projection of an image formed on a color liquid crystal panel, and the like.

2. Description of the Related Art

Short-arc metal halide lamps in which a rare earth metal and a halogen are sealed are used as light sources for studio-lighting and the like because they are high in luminous efficiency in a wavelength region of visible rays and excellent in color rendering properties owing to their possession of spectral characteristics similar to those of sunlight.

However, light sources for the projection of images formed on color liquid crystal panels require spectral characteristics different from those of sunlight and fit for the sensitivity characteristics of color filters thereof. Therefore, conventional short-arc metal halide lamps have been accompanied by a problem that the radiant intensity in a red region is relatively low and the color rendering properties of color liquid crystal displays are hence deteriorated.

In order to enhance the radiant intensity in the red region on the other hand, it is effective to seal lithium within a light-emitting tube.

However, the sealing of lithium involves the following problem. Since lithium is high in reactivity with the glass material making up the light-emitting tube, devitrification of the light-emitting tube, occurs during its operation, so that the luminous flux radiated is reduced as a whole and the radiant intensity of red light is rapidly decreased. Therefore, such sealing fails to provide a sufficient service life.

With the foregoing in view, the present inventor has carried out an extensive investigation. As a result, it has been found that when lutetium (Lu) is sealed within a light-emitting tube, lithium (Li) is additionally sealed in a specific proportion to the lutetium and a halogen is further sealed in a specific range in excess of the lutetium and the lithium, the devitrification of the light-emitting tube can be avoided to diminish the attenuation of luminous flux and spectral characteristics high in radiant intensity of red light are obtained.

SUMMARY OF THE INVENTION

An object of this invention is to provide a lighting lamp in which devitrification of its light-emitting tube to diminish the attenuation of luminous flux is avoided and enhanced radiant intensity of red light results.

In one aspect of this invention, there is provided a lighting lamp comprising a light-emitting tube in which lutetium (Lu), lithium (Li) and a halogen are sealed together with mercury and a rare gas. The lighting lamp satisfies the following conditions (1) and (2):

(1) the proportion Li/Lu (the ratio in terms of the number of atoms of lithium to lutetium) is 0.5 to 1.5; and (2) the amount of the halogen to be sealed in the glass tube is the total of a stoichiometric amount which is necessary and sufficient for the halogen to form halides with lutetium and lithium and an excess amount of $0.5\times10^{-6}$ to $4\times10^{-6}$ molecular mole/cc based on the internal volume of the light-emitting tube.

Since the proportion of lithium to lutetium falls within a specific range and the sealed amount of a halogen amounts to the total of the stoichiometric amount and an excess amount in a specific range, devitrification of the light-emitting tube is satisfactorily avoided together with the attenuation of luminous flux and illuminating light having spectral characteristics high in radiant intensity of red light is hence obtained.

Although the reasons why such excellent effects are exhibited are not necessarily understood, they are believed to be attributed to the following. Namely, since the sealed amount of the halogen is the total of the stoichiometric amount and the excess amount in a specific range, the halogen in the excess amount prevents lithium halide from dissociating, so that the reaction of the light-emitting tube made of glass and lithium is satisfactorily avoided, whereby devitrification of the light-emitting tube does not occur. In addition, lithium stably exhibits an effect enhancing the radiant intensity in the red region.

Incidentally, although lutetium results in enhancement of radiant intensities of blue light and green light and in a low probability of devitrification of the light-emitting tube made of glass because of its low reactivity to the light-emitting tube, it involves a defect that the radiant intensity of red light is too low. For this reason, the sealing only of lutetium and halogen can not provide spectral characteristics high in radiant intensity of the red light. On the other hand, lithium has a merit that it can enhance the radiant intensity of the red light. However, it has a drawback that it is high in reactivity to the light-emitting tube made of glass. For this reason, the sealing only of lithium and halogen provides too low radiant intensities of the blue and green light and can not avoid the devitrification of the light-emitting tube satisfactorily.

According to this invention on the contrary, the devitrification of the light-emitting tube can be avoided and illumination light having spectral characteristics high in radiant intensity of the red light can be obtained stably over a long period of time.

Accordingly, when the lighting lamp according to this invention is used as a light source for the projection of an image formed on a color liquid crystal panel in combination with an optical system, light is efficiently converged and illumination light having spectral characteristics high in radiant intensity of red light and suitable for the sensitivity characteristics of color filters can be obtained without lowering its luminous flux utilization, whereby color liquid crystal displays excellent in color rendering properties can be attained.

BRIEF DESCRIPTION OF THE DRAWINGS

The above and other objects, features and advantages of the present invention will become apparent from the following description and the appended claims, taken in conjunction with the accompanying drawings, in which:

FIG. 2 diagrammatically illustrates the lumen maintenance factor as the operation time goes on.

DETAILED DESCRIPTION OF THE INVENTION AND PREFERRED EMBODIMENTS

Example

The present invention will hereinafter be described specifically by the following Example.

EXAMPLE 1

Figure 1:
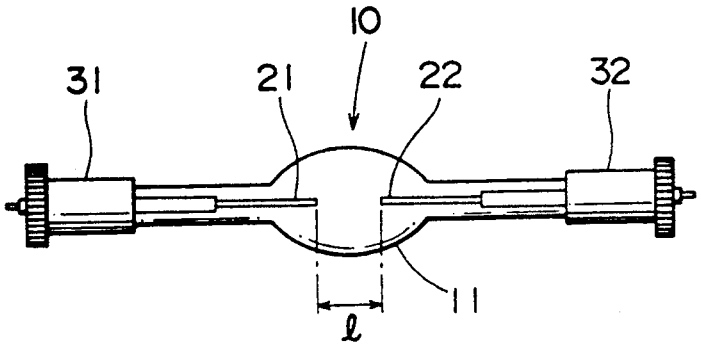
FIG. 1 is a schematic illustration of a lighting lamp.

In this Example, a lighting lamp is fabricated by sealing lutetium, lithium and a halogen in ranges satisfying the above-described conditions (1) and (2) together with mercury and a rare gas within a light-emitting tube 10 made of, for example, quartz glass as illustrated in FIG. 1.

An emission space-surrounding portion 11 is defined in the center of the light-emitting tube 10. Within this emission space-surrounding portion 11, a pair of electrodes 21,22 are disposed in an opposing relation. Discharge of an arc takes place between the pair of electrodes 21,22 during operation to emit light. Numerals 31,32 designate bases.

Mercury and the rare gas are essential components for retaining the discharge of the arc and their sealed amounts are suitably selected. Exemplary rare gases employed in this invention include xenon and argon.

Each of lutetium and lithium may be sealed in the form of its halide. Described specifically, lutetium iodide ($LuI_3$), lutetium bromide ($LuBr_3$), lithium iodide (LiI), lithium bromide (LiBr) and the like are included.

The halogen may be sealed in the form of the lutetium halide or lithium halide as described above. It may also be sealed in the form of a mercury halide, e.g., $HgI_2$.

It is necessary in this invention that the sealed amounts of lutetium, lithium and halogen satisfy the above-described conditions (1) and (2). Namely:

Conditions (1): the proportion Li/Lu (the ratio in terms of the number of atoms of lithium to lutetium) is 0.5 to 1.5.

If this proportion Li/Lu should be less than 0.5, the balance of ligth emission as to red light, blue light and green light will become bad and the radiant intensity of the red light (at 610 nm, 671 nm, etc.) will be relatively weakened.

If the proportion Li/Lu should exceed 1.5, the reaction of lithium with the glass-made light-emitting tube 10 will occur to cause the devitrification of the light-emitting tube to decrease transmission of luminous flux to a great extent.

Condition (2): the sealed amount of the halogen is the total of a stoichiometric amount in which the halogen form halides with lutetium and lithium to be sealed and an excess amount of $0.5\times10^{-6}$ to $4\times10^{-6}$ molecular mole/cc based on the internal volume of the light-emitting tube 10.

If the excess amount of the halogen should be less than $0.5\times10^{-6}$ molecular mole/cc, the devitrification of the light-emitting tube 10 will tend to occur because the reaction of lithium with the light-emitting tube can not be avoided satisfactorily. This is believed to be attributed to a tendency of lithium halide to disassociate in the presence of a smaller amount of excess halogen.

On the other hand, if the excess amount of the halogen should exceed $4\times10^{-6}$ molecular mole/cc, the reaction of the halogen with the electrodes 21,22 will become active, whereby the tube wall of the light-emitting tube 10 tends to be blackened. In addition, free halogen will increase in quantity, resulting in the deterioration of the lighting property of the lamp.

In order to stabilize arc discharge, an alkali metal such as sodium, potassium, rubidium or cesium may be sealed additionally within the light-emitting tube 10 as needed.

Experimental Examples, which were performed with a view toward supporting the effects of this invention, will hereinafter be described.

EXPERIMENTAL EXAMPLE 1

Based on the above-described Example, a lighting lamp of the following specification was fabricated for testing.

| | |
|---|---|
| Outer diameter of the emission space-surrounding portion 11: | 21 mm |
| Internal volume of the light-emitting tube 10: | 2.3 cc |
| Interelectrode distance l (emission length): | 7 mm |
| Rated power consumption: | 400 W |
| Sealed materials: | |
| Lutetium (Lu): | 1.2 mg |
| Lithium iodide (LiI): | 0.9 mg |
| Mercury iodide ($HgI_2$): | 6.8 mg |
| Mercury (Hg): | 40 mg |
| Rare gas (argon) | $4\times10^4$ Pa |

In the above-fabricated lighting lamp, Li/Lu was 1 and the excess amount of the halogen was $2\times10^{-6}$ molecular mole/cc.

This lighting lamp was actually lighted at the rated power consumption (400 W). As a result, its color temperature and whole luminous flux were found to be 5,000K and 32,000 lm (80 lm/W) respectively.

Figure 2:
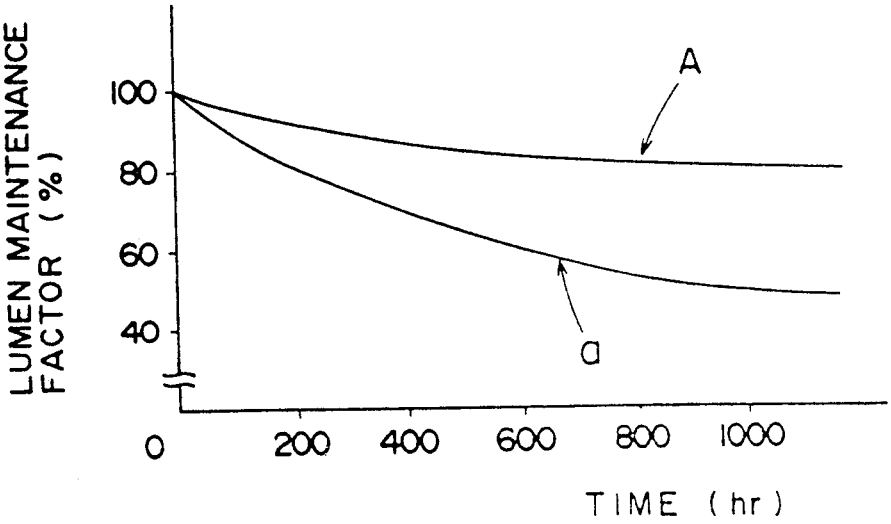

Its lumen maintenance factor as the operation time went on was then investigated. Results shown by a curve A in FIG. 2 were obtained. Namely, the lighting lamp according to this Experimental Example exhibits low variations of luminous flux with time and hence can provide lighting light stably over a long period of time.

Figure 3:
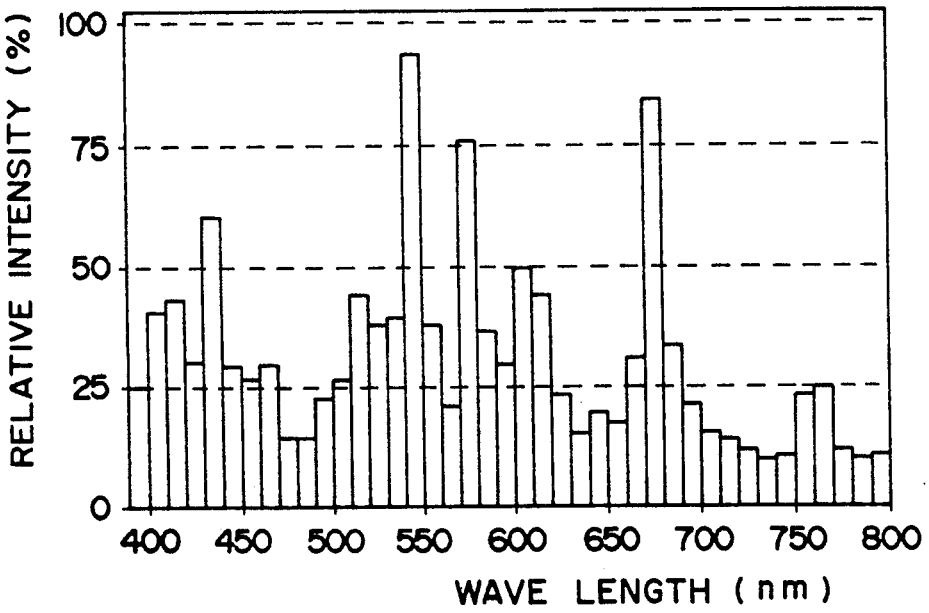
FIG. 3 diagrammatically illustrates the spectral characteristics of a lighting lamp in Experimental Example 1.

In addition, its spectral characteristics were investigated. Results shown in FIG. 3 were obtained. Namely, the lighting lamp according to this Experimental Example is sufficiently high in radiant intensity of red light (610 nm, 671 nm) in addition to the radiant intensities of blue light and green light and hence has spectral characteristics suitable for the sensitive characteristics of color filters mounted on color liquid crystal panels.

COMPARATIVE EXPERIMENTAL EXAMPLE 1

For the sake of comparison, a lighting lamp was fabricated in the same manner as in the above Experimental Example 1 except that the sealed materials were changed in the following way.

Sealed materials:

Lutetium (Lu): 1.2 mg

Lithium iodide (LiI): 0.9 mg

Mercury iodide ($HgI_2$): 9.9 mg

Mercury (Hg): 40 mg

Rare gas (argon): $4\times10^4$ Pa

In the above-fabricated lighting lamp, Li/Lu was 1 and the excess amount of the halogen was $5\times10^{-6}$ molecular mole/cc.

This comparative lighting lamp was actually lighted at the rated power consumption to investigate its lumen maintenance factor as the operation time went on. Results shown by a curve a in FIG. 2 were obtained.

Namely, the comparative lighting lamp was great in variations of luminous flux with time and short in service life.

Having now fully described the invention, it will be apparent to one of skill in the art that many changes and modifications can be made thereto without departing from the spirit or scope of the invention as set forth herein.

What is claimed is:

1. In a lighting lamp comprising a light-emitting tube in which lutetium (Lu), lithium (Li) and a halogen are sealed together with mercury and a rare gas, the improvement wherein the lighting lamp satisfies the following conditions (1) and (2):

(1) the atomic proportion Li/Lu is 0.5 to 1.5; and (2) the sealed amount of the halogen is the total of a stoichiometric amount in which the halogen forms halides with lutetium and lithium to be sealed and an excess amount of $0.5\times10^{-6}$ to $4\times10^{-6}$ molecular mole/cc based on the internal volume of the light-emitting tube.

2. The lighting lamp as claimed in claim 1, wherein an alkali metal is additionally sealed within the light-emitting tube.

3. The lighting lamp as claimed in claim 1, which is used as a light source for projection of an image formed on a color liquid crystal panel.

* * * * *